US010061238B2

(12) United States Patent
Song et al.

(10) Patent No.: US 10,061,238 B2
(45) Date of Patent: Aug. 28, 2018

(54) IMAGE FORMING APPARATUS WITH FUSER DRIVER AND METHOD FOR CONTROLLING THEREOF

(71) Applicant: S-PRINTING SOLUTION CO., LTD., Suwon-si (KR)

(72) Inventors: Young-jun Song, Seoul (KR); Chang-su Ma, Yongin-si (KR); Sung-kyu Choi, Pyeongtaek-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/069,159

(22) Filed: Mar. 14, 2016

(65) Prior Publication Data

US 2017/0108806 A1 Apr. 20, 2017

(30) Foreign Application Priority Data

Oct. 20, 2015 (KR) ..... 10-2015-0146110

(51) Int. Cl.
*G03G 15/20* (2006.01)
*G03G 15/00* (2006.01)

(52) U.S. Cl.
CPC ..... *G03G 15/2053* (2013.01); *G03G 15/80* (2013.01)

(58) Field of Classification Search
CPC ..... G03G 15/205
See application file for complete search history.

(56) References Cited

U.S. PATENT DOCUMENTS 5,907,743 A * 5/1999 Takahashi ..... G05D 23/1913 399/67
2010/0028037 A1* 2/2010 Song ..... G03G 15/2039 399/70
2010/0166447 A1* 7/2010 Cook ..... G03G 15/2039 399/88
2011/0227489 A1* 9/2011 Huynh ..... H05B 33/083 315/185 R
2015/0063847 A1* 3/2015 Yokomizo ..... G03G 15/2046 399/45

FOREIGN PATENT DOCUMENTS

JP 03221983 A * 9/1991
JP 08123245 A * 5/1996
JP 2001305905 A * 11/2001

OTHER PUBLICATIONS

JP_2001305905_A_T Machine Translation 2001 Oshima Japan.*

(Continued)

*Primary Examiner* — Victor Verbitsky
(74) *Attorney, Agent, or Firm* — Staas & Halsey LLP

(57) ABSTRACT

An image forming apparatus includes a fuser configured to fuse printing paper where a toner has been developed; and a fuser driver configured to provide power being provided from an external AC to a heating element inside the fuser so that the fuser has a predetermined temperature, wherein, in response to an operational state of the image forming apparatus being at a waiting state, the fuser driver performs a phase control on the power being provided to the heating element using AC power of sections other than a phase angle of a range predetermined based on a peak voltage value of the external AC power.

20 Claims, 11 Drawing Sheets

(56) References Cited

OTHER PUBLICATIONS

JP_08123245A_T Machine Translation Shiina 1996 Japan.*
JP_03221983_A_T Machine Translation Aoki 1991 Japan.*
JP_2001305905_A_T Machine Translation 2001 Oshima.*
JP_08123245_A_T Machine Translation Shiina 1996 Japan.*
Samsung Smart MultiXpress 7 Press Release dated May 26, 2015, 2 pages.

* cited by examiner (a)

(b)

IMAGE FORMING APPARATUS WITH FUSER DRIVER AND METHOD FOR CONTROLLING THEREOF

CROSS-REFERENCE TO RELATED APPLICATIONS

This application claims priority from Korean Patent Application No. 10-2015-0146110, filed on Oct. 20, 2015, in the Korean Intellectual Property Office, the disclosure of which is incorporated herein by reference in its entirety.

BACKGROUND

1. Field

The following description relates to an image forming apparatus and a controlling method thereof, and more particularly, to an image forming apparatus capable of preventing noise while satisfying flicker standards, and a controlling method thereof.

2. Description of the Related Art

An image forming apparatus refers to an apparatus configured to print on printing paper print data generated in a printing control terminal apparatus such as a computer. Examples of such an image forming apparatus include a copy machine, printer, facsimile, and an MFP (Multi Function Peripheral) that provides all the functions of a copy machine, printer, and facsimile through one device.

An image forming apparatus is capable of forming an image in various methods. One of those methods is the electrophotography method. The electrophotography method includes electrifying a photosensitive body, forming a latent image through light exposure, performing a developing operation of applying a toner on the latent image, transcribing the developed toner on printing paper, and fusing the same, thereby forming an image.

Thus, an image forming apparatus may adopt a configuration for ultimately fusing an image on printing paper. This configuration is referred to as a fuser.

Meanwhile, electric, electronic, and communication devices must satisfy various EMC standards, among which harmonic standards and flicker standards are related to fusing operations of the image forming apparatus.

In order to satisfy the aforementioned flicker standards, a phase control may be used in a fuser, but conventional phase control methods lead to rapid current changes (di/dt) in harmonic inductors mounted to satisfy the harmonic standards, thereby generating noise, which is a problem.

Therefore, there is needed a method for driving a fuser with reduced noise while satisfying the flicker standards.

SUMMARY

Additional aspects and/or advantages will be set forth in part in the description which follows and, in part, will be apparent from the description, or may be learned by practice of the disclosure.

Various embodiments of the present disclosure are directed to provide an image forming apparatus capable of preventing noise while satisfying the flicker standards, and a controlling method thereof.

According to an embodiment of the present disclosure, an image forming apparatus includes a fuser configured to fuse printing paper where a toner has been developed; and a fuser driver configured to provide power being provided from an external AC to a heating element inside the fuser so that the fuser has a predetermined temperature, wherein, in response to an operational state of the image forming apparatus being at a waiting state, the fuser driver performs a phase control on the power being provided to the heating element using AC power of sections other than a phase angle of a range predetermined based on a peak voltage value of the external AC power.

In this case, in response to the operational state of the image forming apparatus being at a printing state, the fuser driver may perform a phase control on power being provided to the heating element using AC power of all sections.

Meanwhile, in response to a temperature of the fuser being in a first temperature range, the fuser driver may perform a phase control on the AC power being provided to the heating element, and in response to the temperature of the fuser being in a second temperature range that is higher than the first temperature range, the fuser driver may perform a waveform number control on the AC power being provided to the heating element.

Meanwhile, the fuser driver may perform a phase control such that the AC power is not provided to the heating element in sections where the phase of the external AC power is 75 to 105 degrees and 255 degrees to 285 degrees.

Meanwhile, the heating element may include a first heating element and a second heating element, and the image forming apparatus may further include a plurality of switching elements for changing a connection state of the first heating element and second heating element with the external power to be in series or in parallel, and the fuser driver may control the plurality of switching elements such that, in response to the operational state of the image forming apparatus being at a waiting state, the first heating element and second heating element are connected to the external power in series, and in response to the operational state of the image forming apparatus being at a printing state, the first heating element and second heating element are connected to the external power in parallel.

Meanwhile, the fuser driver may include an input configured to receive input of external AC power; a zero cross sensor configured to sense a zero cross point of the input AC power, temperature sensor configured to sense a temperature of the fuser; a switching element configured to selectively output the input AC power to the heating element; and a fuser controller configured to control operations of the switching element using the sensed zero cross point and sensed temperature of the fuser.

Meanwhile, the fuser controller may compare the sensed temperature and predetermined target temperature and compute a duty value, calculate a phase control time of the AC power to be provided to the fuser using the computed duty value and sensed zero cross point, and control the switching element based on the calculated phase control time.

Meanwhile, in response to the sensed temperature being the same or above a predetermined temperature range, the fuser controller may perform a waveform number control regarding the AC power being provided to the heating element.

Meanwhile, the switching element may be a TRIAC.

Meanwhile, the fuser driver may further include a coil arranged between the switching element and heating element.

Meanwhile, the fuser driver may further include a rectifier configured to wave-rectify the input external AC; and a coil arranged between the input end and rectifier, wherein the switching element is a field-effect transistor.

According to an embodiment of the present disclosure, an image forming apparatus includes a fuser configured to fuse printing paper where a toner has been developed; and a fuser driver configured to provide power being provided from an external AC to a first heating element and second heating element inside the fuser so that the fuser has a predetermined temperature, wherein, in response to an operational state of the image forming apparatus being at a waiting state, the fuser driver connects the first heating element and second heating element in series and provides the external AC, and in response to the operational state of the image forming apparatus being at a printing state, the fuser driver connects the first heating element and second heating element in parallel and provides the external AC.

Meanwhile, the fuse driver may include a temperature sensor configured to sense a temperature of the fuser, an input configured to receive input of the external AC, a coil connected to one end of the input, a first switching element arranged between the coil and first heating element and configured to selectively provide the external AC to the first heating element, a second switching element arranged between the coil and second heating element and configured to selectively provide the external AC to the second heating element, a third switching element configured to selectively connect another end of the first heating element with one end of the second heating element, a fourth switching element configured to selectively connect another end of the first heating element with another end of the input; and a fuser controller configured to, in response to the operational state of the image forming apparatus being at a waiting state, control the fourth switching element to maintain a turn-on state, and the second switching element and third switching element to maintain a turn-off state, and control the first switching element according to the sensed temperature, and in response to the operational state of the image forming apparatus being at a printing state, control the third switching element and fourth switching element to maintain a turn-off state, and control the first switching element and second switching element separately according to the sensed temperature.

According to an embodiment of the present disclosure, a driving control method includes sensing a temperature of the fuser; generating a driving signal based on the sensed temperature; and providing external AC power selectively to a heating element of the fuser according to the generated driving signal; wherein the generating a driving signal involves, in response to an operational state of an image forming apparatus being at a waiting state, generating a driving signal using sections other than a phase angle of a range predetermined based on a peak voltage value of the external AC power.

Meanwhile, the generating a driving signal may involve, in response to the operational state of the image forming apparatus being at a printing state, generating a driving signal using AC power of all sections.

Meanwhile, the generating a driving signal may involve, in response to a temperature of the fuser being in a first temperature range, performing a phase control on the AC power being provided to the heating element to generate the driving signal, and in response to the temperature of the fuser being in a second temperature range that is higher than the first temperature range, performing a waveform number control on the AC power being provided to the heating element to generate the driving signal.

Meanwhile, the generating a driving signal may involve generating a driving signal such that the AC power is not provided to the heating element in sections where the phase of the external AC power is 75 to 105 degrees and 255 degrees to 285 degrees.

Meanwhile, the method may further include sensing a zero cross point of the external AC power, wherein the generating a driving signal involves generating the driving signal using the sensed zero cross point.

Meanwhile, the generating a driving signal may involve comparing the sensed temperature and predetermined target temperature to compute a duty value, calculating a phase control time of the AC power to be provided to the fuser using the computed duty value and sensed zero cross point, and generating the driving signal based on the calculated phase control time.

Meanwhile, the heating element may include a first heating element and a second heating element, and he providing external AC power selectively may involve, in response to the operational state of the image forming apparatus being at a waiting state, connecting the first heating element and second heating element in series and providing the external AC, and in response to the operational state of the image forming apparatus being at a printing state, connecting the first heating element and second heating element in parallel and providing the external AC.

BRIEF DESCRIPTION OF THE DRAWINGS

The above and/or other aspects of the present disclosure will be more apparent by describing certain embodiments of the present disclosure with reference to the accompanying drawings, in which.

DETAILED DESCRIPTION

Figure 1:
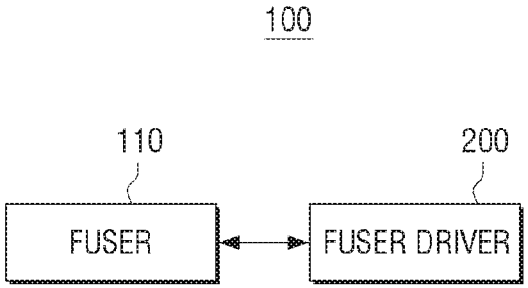
FIG. 1 is a block diagram illustrating a simplified configuration of an image forming apparatus according to an embodiment of the present disclosure.

Reference will now be made in detail to the embodiments, examples of which are illustrated in the accompanying drawings, wherein like reference numerals refer to like elements throughout. The embodiments are described below to explain the present disclosure by referring to the figures.

Prior to specifically explaining the present disclosure, the method of disclosing the present specification and the drawings will be explained below.

First of all, the words used in the present specification and in the claims were selected from generally used terms in consideration of the functions of various embodiments of the present disclosure. However, the meanings of these words may vary depending on the intentions of one skilled in the art, technical interpretation, and advent of a new technology. Furthermore, some of the words herein may have been randomly selected by the applicant of this specification. These words may be interpreted to mean as defined in this specification, and unless there are specific definitions, they may be interpreted based on the overall disclosure of the present specification and the general technical common sense of one skilled in the art.

Furthermore, like reference numerals in the drawings refer to like parts or components that perform substantially the same functions. For the sake of easy understanding an explanation, like reference numerals will be used in different embodiments as well. That is, even if like reference numerals are used in a plurality of drawings, it does not necessarily mean that all the drawings belong to the one same embodiment.

Furthermore, words that include ordinal numerals such as "the first" and "the second" may be used to differentiate between the components in this specification and in the claims. These ordinal numerals are used to differentiate between the same or similar components, and thus the use of such ordinal numerals is not intended to limit the meanings of the words. For example, the order of use or order of arrangement of a component combined with such an ordinal numeral shall not be limited by that ordinal numeral. When necessary, the ordinal numerals may be exchanged between one another.

Unless mentioned otherwise, any singular expression includes a plural expression. In the present application, words such as "include" or "consist of" are used to designate that the characteristics, numbers, steps, operations, components, parts or a combination thereof disclosed in the present specification exist, but not to exclude the possibility of existence or addition of one or more of other characteristics, numbers, steps, operations, components, parts or a combination thereof.

Furthermore, in an embodiment of the present disclosure, a part being connected to another part includes the part being connected to the another part indirectly via another medium. Furthermore, a part including another component means that any other component may also be further included unless mentioned otherwise.

Hereinafter, an embodiment of the present disclosure will be explained in further detail with reference to the drawings attached.

FIG. 1 is a block diagram illustrating a simplified configuration of an image forming apparatus according to an embodiment of the present disclosure.

Referring to FIG. 1, an image forming apparatus 100 according to the present embodiment consists of a fuser 110 and fuser driver 200. Such an image forming apparatus 100 may be a printer, scanner, copy machine, facsimile, or an MFP (Multi Function Peripheral) configured to provide all the functions of a printer, scanner, copy machine, and facsimile through one apparatus.

The fuser 110 fuses printing paper on which a toner has been developed. More specifically, the fuser 110 applies heat and pressure to the printing paper to fuse the electrified toner on the printing paper. Such a fuser 110 may include a heating roller and pressurizing roller.

The heating roller may be heated to a predetermined temperature, and heat the printing paper so that the electrified toner on the printing paper may be easily fused.

Such a heating roller has a heating element (for example, heater lamp) for heating a heating roller to a predetermined temperature. There may be one heating element or a plurality of heating elements in the heating roller. Such a heating element may be heated by the power provided from a fuser driver 200 that will be explained hereinafter.

A pressurizing roller is a roller configured to provide high pressure on printing paper so that electrified toner may be easily fused. The pressurizing roller is pressure-welded to a heating roller and forms a nib.

The fuser driver 200 may be realized as a processor, ASIC, or CPU and the like. The fuser driver 200 may control the power being supplied to the heating element so that the heating roller has a predetermined temperature state according to the operational state of the image forming apparatus 100. For example, in response to the image forming apparatus 100 being at a printing state, the fuser driver 200 may control the power being supplied to the heating element so that the heating roller has a predetermined temperature necessary for fusing. In addition, even in response to the image forming apparatus 100 being at a waiting state or preparation state, for quick printing, the fuser driver 200 may control the power being supplied to the heating element so that the heating roller has a lower temperature than the temperature necessary for fusing.

The fuser driver 200 may control the power being supplied to the heating element in a suitable control method depending on the temperature state of the fuser 110 and the operational state of the image forming apparatus 100.

More specifically, in response to the operational state of the image forming apparatus 100 being at an initial on state (or preparation state), the fuser driver 200 may control the power being supplied to the heating element in a phase control method of avoiding a predetermined phase according to an embodiment of the present disclosure. Herein, the phase control involves performing a phase control using the AC power of sections other than the phase angle of a predetermined range on the basis of the peak power peak value of an external AC power. This will be explained in more detail with reference to FIG. 5 below.

Furthermore, in response to the operational state of the image forming apparatus 100 being at a printing state, the fuser driver 200 may perform a phase control on the power being supplied to the heating element using all sections of the AC power.

Furthermore, the fuser driver 200 may control the power being supplied to the heating element in different control methods depending on the temperature of the fuser 110 (more specifically heating roller). More specifically, in response to the temperature of the fuser 110 being in a first temperature range, it is possible to perform a phase control regarding the AC power being provided to the heating element, and in response to the temperature of the fuser 110 being in a second temperature range that is higher than the first temperature range, it is possible to perform a waveform number control regarding the AC power being provided to the heating element. Herein, the waveform number control is a method of controlling such that a predetermined wave number is not provided to the heating element of the AC power being provided to the heating element. Meanwhile, even in the case of performing a waveform number control, it is possible to sequentially change the waveform number being transmitted.

Meanwhile, in the case where the fuser 110 has a plurality of heating elements and it is possible to change the arrangement format of the plurality of heating elements, in response to the operational state of the image forming apparatus 100 being at a waiting state, the fuser driver 200 may allow the plurality of heating elements to be connected in series regarding the AC power, and supply the power to the heating elements. In addition, in response to the operational state of the image forming apparatus 100 being at a printing state, the fuser driver 200 may allow the plurality of heating elements to be connected in parallel regarding the AC power, and supply power to each of the plurality of heating elements. This arrangement type will be explained in more detail with reference to FIG. 8.

As aforementioned, the image forming apparatus 100 according to the present embodiment is capable of either not providing the power of a predetermined phase to a heating element at a preparation state that consumes a lot of power or connecting a plurality of heating elements in parallel to reduce the through-current being introduced into the heating elements, thereby preventing flickering and preventing noise from occurring in the inductor.

So far a simplified configuration of an image forming apparatus was illustrated and explained, but when realizing the image forming apparatus, various components may be further added. This will be explained in more detail with reference to FIG. 2.

Figure 2:
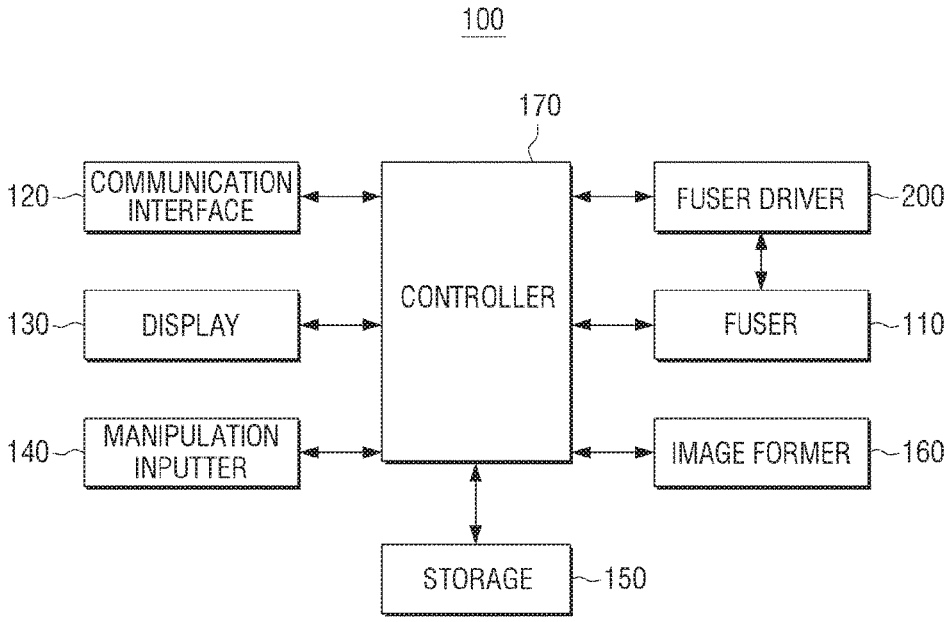
FIG. 2 is a block diagram illustrating a detailed configuration of an image forming apparatus according to an embodiment of the present disclosure.

FIG. 2 is a block diagram illustrating a detailed configuration of an image forming apparatus according to an embodiment of the present disclosure.

Referring to FIG. 2, the image forming apparatus 100 includes a fuser 110, communication interface 120, display 130, manipulation input 140, storage 150, image former 160, controller 170, and fuser driver 200.

The fuser 110 and fuser driver 220 perform a fusing function. In the image forming apparatus 100, only the fuser 110 and fuser driver 200 may be referred to as the fuser, and the detailed configuration and operations of the fuser will be explained with reference to FIGS. 3 to 10.

The communication interface 120 may be connected to a terminal apparatus (not illustrated) such as a mobile device (smart phone, tablet PC), PC, notebook PC, PDA, and digital camera and the like, and receive file and printing data from the terminal apparatus (not illustrated). More specifically, the communication interface 120 may be formed to connect the image forming apparatus 100 to an external apparatus, or to a terminal apparatus through LAN (Local Area Network) and internet, or to a USB (Universal Serial Bus) port or wireless communication (for example, WiFi 802.11a/b/g/n, NFC, Bluetooth) port.

The display 130 displays various pieces of information to be provided in the image forming apparatus 100. More specifically, the display 130 may display a user interface window from which various functions provided by the image forming apparatus 100 may be selected. Such a display 130 may be a monitor such as an LCD, CRT, and OLED, or a touch screen capable of performing functions of the manipulation input 140 to be explained at the same time.

Furthermore, the display 130 may display a control menu for performing the functions of the image forming apparatus 100.

The manipulation input 140 may receive input by a user of selecting a function or a control command regarding a function. Herein, examples of the function include printing function, copying function, scanning function, and facsimile transmitting function. Such a manipulation input 140 may receive input through a control menu being displayed on the display 130.

Such a manipulation input 140 may be realized as a plurality of buttons, a keyboard, a mouse and the like. Otherwise, it may be realized as a touch screen that may perform the functions of the aforementioned display 130 at the same time.

The storage 150 may store printing data received through the communication interface 120. Furthermore, the storage 150 may store various fusing conditions (for example, temperature conditions according to the operational state of the image forming apparatus 100). Such a storage 150 may be realized as a storage medium provided inside the image forming apparatus 100, an external storage medium, for example a removable disk including a USB memory, a storage medium connected to the host, or a web server through the network and the like.

The image former 160 may print printing data. More specifically, the image former 160 may parse a file prestored in the storage 150 or printing data received from the terminal apparatus (not illustrated), and may render the parsed data and then print the rendered data on printing paper.

The controller 170 controls each component inside the image forming apparatus 100. More specifically, the controller 170 may be realized as a processor or CPU to determine the operational state of the image forming apparatus 100. For example, in response to the image forming apparatus 100 being initially turned on, or in response to determining that a printing operation will start soon (for example, when the user controlled the manipulation input or received printing data), the controller 170 may determine that the operational state of the image forming apparatus 100 is at a preparation state (or ready state). Herein, the controller 170 may control the fuser driver 200 to have a fusing temperature according to an initial state.

Furthermore, in response to receiving printing data from outside and determining that it is at a state where operations such as parsing have been completed and thus a printing operation must start, the controller 170 may determine that the operational state of the image forming apparatus 100 is at a printing state. Herein, the controller 170 may control the image former 160 to perform a series of processes so that an electrified toner may be developed on printing paper, and also control the fuser driver 200 to have a temperature necessary for fusing. Furthermore, when the electrified toner is developed on the printing paper, the controller 170 may control the fuser 110 so that the electrified toner may be fused on the printing paper.

Furthermore, when a predetermined time has passed after a printing operation has been completed, the controller 170 may determine that the operational state of the image forming apparatus 100 is at a waiting mode. Herein, the controller 170 may control the fuser driver 200 such that the fuser 100 maintains a temperature that is lower than the temperature necessary for fusing.

Meanwhile, regarding FIGS. 1 and 2, it was explained that the fuser driver 200 performs fusing functions according to controls made by the controller 170, but the fuser driver 200 may be realized to perform fusing functions according to controls made by the image former 160 instead. Furthermore, the fuser driver 200 and fuser 110 may be realized as components provided inside the image former 160.

Furthermore, referring to FIGS. 1 and 2, only general functions of the image forming apparatus 100 were illustrated and explained, but the image forming apparatus 100 may further include a scanner configured to perform scanning functions according to the functions being provided by the image forming apparatus 100 and a fax transceiver configured to perform fax transceiving functions according to the functions being provided by the image forming apparatus 100.

Figure 3:
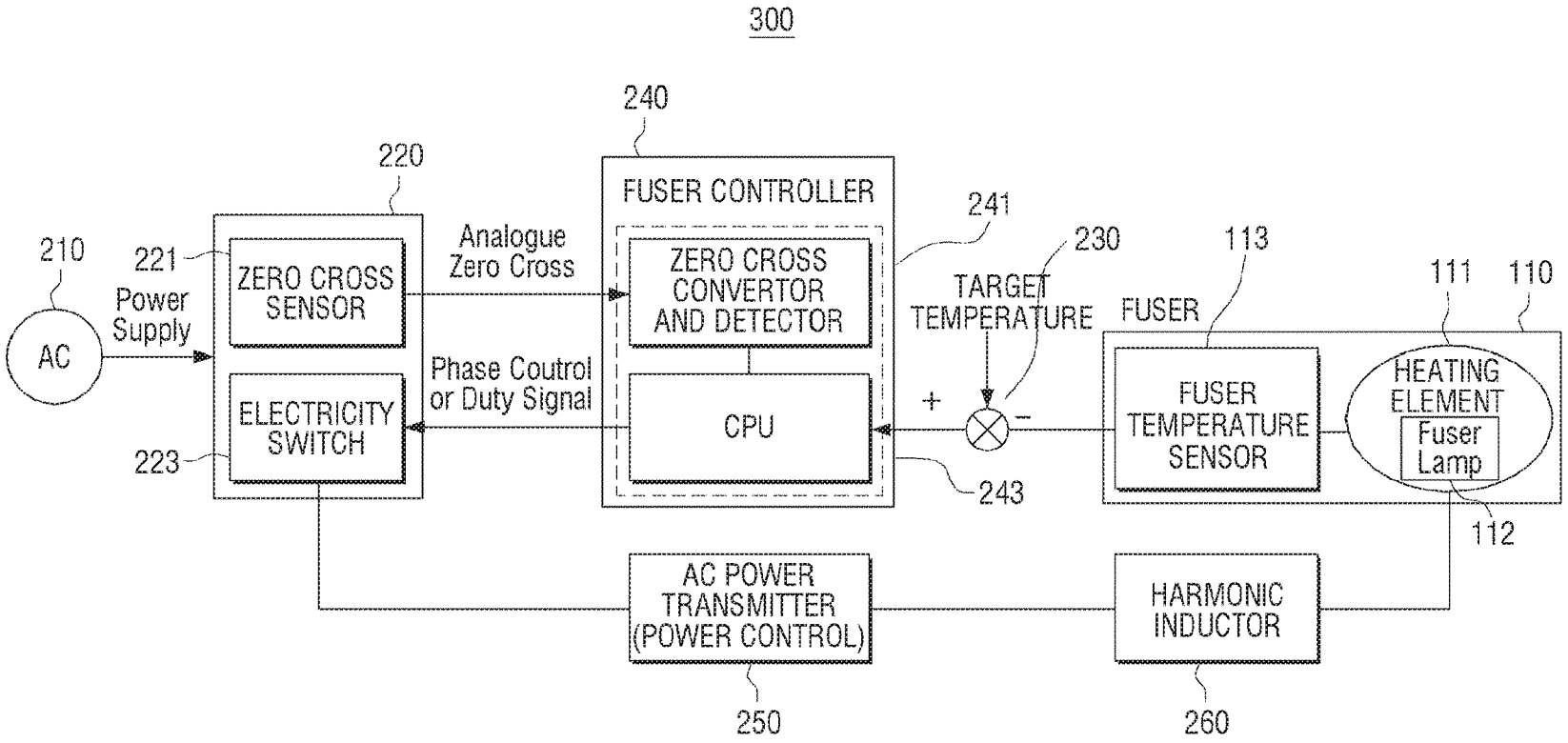
FIG. 3 is a block diagram illustrating a detailed configuration of a fuser according to an embodiment of the present disclosure.

FIG. 3 is a block diagram illustrating a detailed configuration of a fuser according to an embodiment.

Referring to FIG. 3, the fuser 300 includes a fuser 110, input (or power supply) 210, circuit 220, temperature sensor 230, fuser controller 240, electricity transmitter 250, and harmonic inductor 260.

The fuser 110 may include a heating element 111 configured to receive power through the harmonic inductor 260, and a temperature sensor 113 configured to sense the temperature of a heating roller inside the fuser 110. Such a heating element 111 may be provided with a heater lamp 112 configured to receive electric energy and generate heat energy. In FIG. 3, the heating element and heater lamp are illustrated separately, but for the sake of easy explanation, the heating element and heater lamp will both be referred to as a heating element without differentiation.

The input 210 receives external AC power, and provides the received AC power to the circuit 220.

The circuit 220 may receive AC power from the input 210, sense a zero cross point of the received AC power, and transmit the AC power to the electricity transmitter 250 selectively, according to controls made by the fuser controller 240. Such a circuit 220 may include a zero cross sensor 221 and electricity switch 223.

The zero cross sensor 221 senses a zero cross point of the received AC power. More specifically, the zero cross sensor 221 may include a resistor and photocoupler.

The resistor is connected to the AC input 210 in parallel, and the photocoupler may transmit the voltage being applied to the resistor to the fuser controller 240 to be explained in an optical method. A sense signal being output from such a zero cross sensor 221 may have an analogue signal waveform of which the size has been reduced than the received AC power. Hereinabove, it was explained that the zero cross sensor 221 including a resistor and photocoupler is used, but a zero cross may be sensed using another type of circuit configuration.

The electricity switch 223 may selectively output the AC power received in the input 210 to the heating element. More specifically, the electricity switch 223 may include a TRIAC. However, although the electricity switch hereinabove is configured using a TRIAC, other types of configuration, such as a relay switch, for example, may be adopted instead of the TRIAC as long as it is capable of control switching of AC power.

The temperature sensor 230 senses the temperature of the fuser 110 based on a sensing value being received from the temperature sensor 113 provided inside the fuser 110. Herein, the temperature sensor 230 may provide a difference between a pre-stored target temperature value and a sensed sensing value to the fuser controller 240. However, in an embodiment, the sensed temperature information may be provided to the fuser controller 240.

The fuser controller 240 controls operations of the electricity switch 223 using the sensed zero cross point and the sensed temperature of the fuser 110. More specifically, the fuser controller 240 may include a zero cross convertor and detector 241 and CPU 243.

The zero cross convertor and detector 241 perceives the zero cross point using the signal transmitted through the aforementioned zero cross sensor 221. More specifically, the zero cross convertor and detector 241 may receive a sine waveform of which the size has been reduced through the sensor 221, and generate a digital square wave reference signal from the analogue sine waveform signal.

The CPU 243 receives temperature information from the temperature sensor 230. Herein, the CPU 243 may receive a difference value between a target temperature value and the sensed temperature value, in which case a duty value may be computed based on the received information. However, the CPU 243 may be realized to receive only a currently sensed temperature value from the temperature sensor 230, arithmetize a pre-stored target value and the sensed temperature value, and compute a duty value using the result of arithmetization.

Furthermore, the CPU 243 may receive a reference signal of a square wave that is the zero cross point from the zero cross convertor and detector 241, and receive operational state information of the image forming apparatus 100 from the controller 170 of the image forming apparatus 100.

Furthermore, the CPU 243 may determine the method of controlling the heating element according to the operational state of the image forming apparatus 100 and the sensed temperature state of the fuser 110, and generate a driving signal to control the electricity switch 223 according to the determined controlling method. More specifically, in response to the operational state of the image forming apparatus 100 being at a waiting state or preparation state, the CPU 243 may generate a driving signal in a phase control method of not using a predetermined phase. Furthermore, in response to the temperature of the fuser 110 being the same or above a predetermined temperature, the CPU 243 may generate a driving signal in a waveform number control method.

Meanwhile, in response to the operational state of the image forming apparatus 100 being at a printing state, the CPU 243 may generate a driving signal in a phase control method using all the phases of the AC.

Herein, the phase control method is a method of providing only a predetermined phase of among the phases of the AC power to the heating element. In the present embodiment, a phase control is performed avoiding sections where currents change rapidly. More specifically, it is possible to perform a phase control such that the AC power is not provided to the heating element in a section where the phase of the external AC power is approximately 75 to approximately 105 degrees and approximately 225 to approximately 285 degrees. Below, operations of the CPU 243 in the case of performing a phase control will be explained in detail.

In the case of being driven in a phase control method, the CPU 243 compares the temperature of the fuser 110 and the target temperature to compute a duty value, and calculates a phase control time of the AC power to be provided to the fuser 110 using a previously sensed zero cross point. The CPU 243 may then generate a driving signal based on the calculated phase control time. Herein, as aforementioned, the CPU 243 may generate a driving signal regarding sections other than a predetermined phase angle and not all the phases of the AC power. This will be explained in more detail hereinafter with reference to FIG. 5.

Furthermore, in the case of being driven in a waveform number control method, the CPU 243 may compare the temperature of the fuser 110 and the target temperature to compute a waveform number to be provided, calculate a waveform number time of the AC power to be provided to the fuser 110 using a previously sensed zero cross point, and generate a driving signal based on the calculated wave number time.

The electricity transmitter 250 provides the AC power output from the electricity switch 223 to the fuser 110 through the harmonic inductor 260.

The harmonic inductor 260 provides the power transmitted from the electricity transmitter 250 to the heating element 112 of the fuser 110. More specifically, for harmonic wave attenuation, the harmonic inductor 260 may be arranged between the electricity transmitter 250 and fuser 110. However, although a harmonic inductor is used in the illustrated embodiments, other elements that include a coil such as an inductor or transformer may be used instead of the harmonic inductor as long as harmonic wave attenuation is possible.

As aforementioned, the fuser according to the present embodiment 300 does not provide a predetermined phase that consumes a lot of power at a preparation state to the heating element, thereby preventing flickering. Furthermore, because it provides power to the heating element in a waveform number control method after an initial driving, noise may be prevented from being generated in the inductor.

Figure 4:
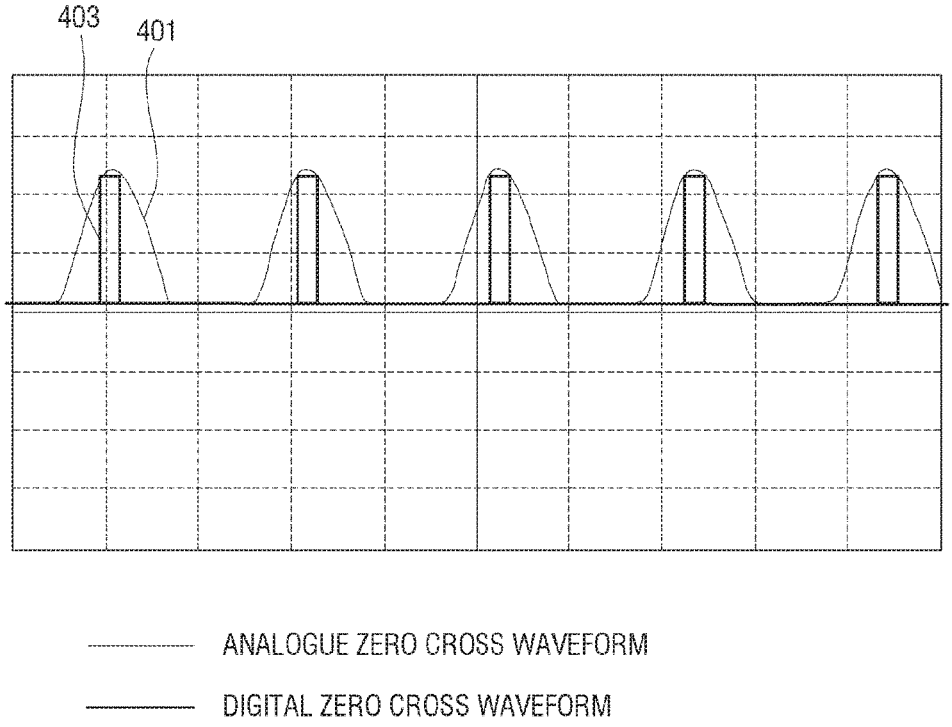
FIG. 4 is a view for explaining operations of a zero cross sensor of FIG. 3.

FIG. 4 is a view for explaining operations of a zero cross sensor of FIG. 3.

In the present embodiment, a phase control is used to control the power being input to the heating element, and for such a phase control, it is necessary to identify the exact phase of the AC power being input. Accordingly, the present embodiment uses a zero cross (ZC) signal. Herein, the ZC signal is a point where the power peak value of the AC signal is 0, that is, a point where the AC phase is 0 degrees or 180 degrees.

Referring to FIG. 4, the zero cross sensor 221 outputs a sensing signal 401 of which the voltage size of the sine waveform has been reduced using the resistor and photocoupler. The fuser controller 240 that received such a sensing signal may generate a digital square wave reference signal 403 from the analogue sine waveform signal received.

Figure 5:
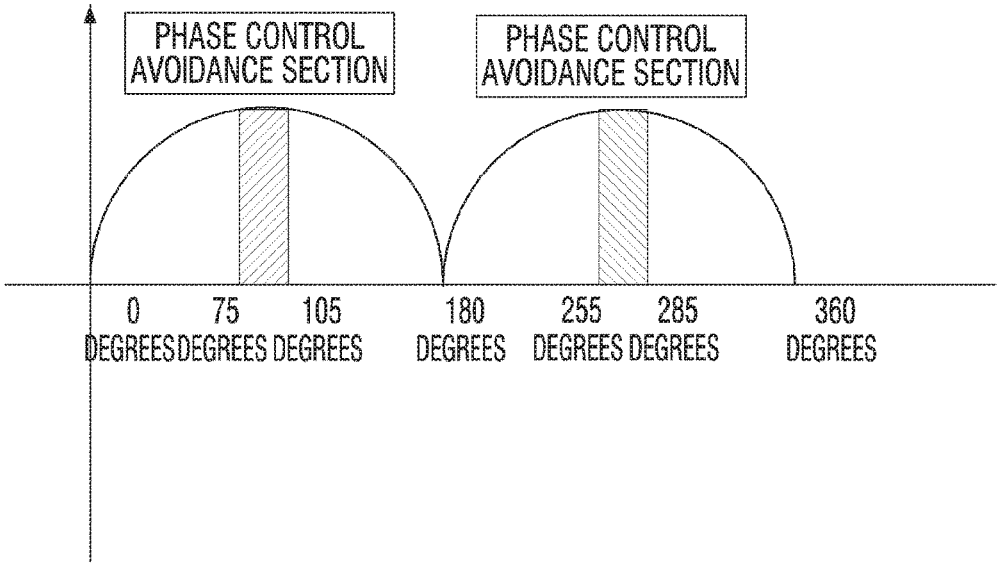
FIG. 5 is a view for explaining a phase control of avoiding a predetermined phase according to an embodiment of the present disclosure.

FIG. 5 is a view for explaining a phase control of avoiding a predetermined phase according to an embodiment of the present disclosure.

Referring to FIG. 5, the AC power has a periodical phase angle of 0~360 degrees. Meanwhile, a range predetermined based on the peak voltage value of the AC power (ex 90 degrees, 270 degrees) is a section where current changes rapidly, and in this section a phase control is performed such that the AC power (more specifically, rectified AC power) is not transmitted to the heating element. As such, because a switching element is not turned on in a section having a large through current, it is not only possible to prevent flickering, but also reduce noise in the inductor.

The aforementioned phase angle may be expressed in a predetermined time from the zero cross. For example, in the case of 50 Hz AC, the switching element may not be turned on in the ±1.5 ms section on the basis of 5 ms in an AC half-wave. Meanwhile, in the case of 60 Hz Ac, the switching element may not be turned on in the ±1.245 ms section on the basis of 4.15 ms in an AC half-wave.

Figure 6:
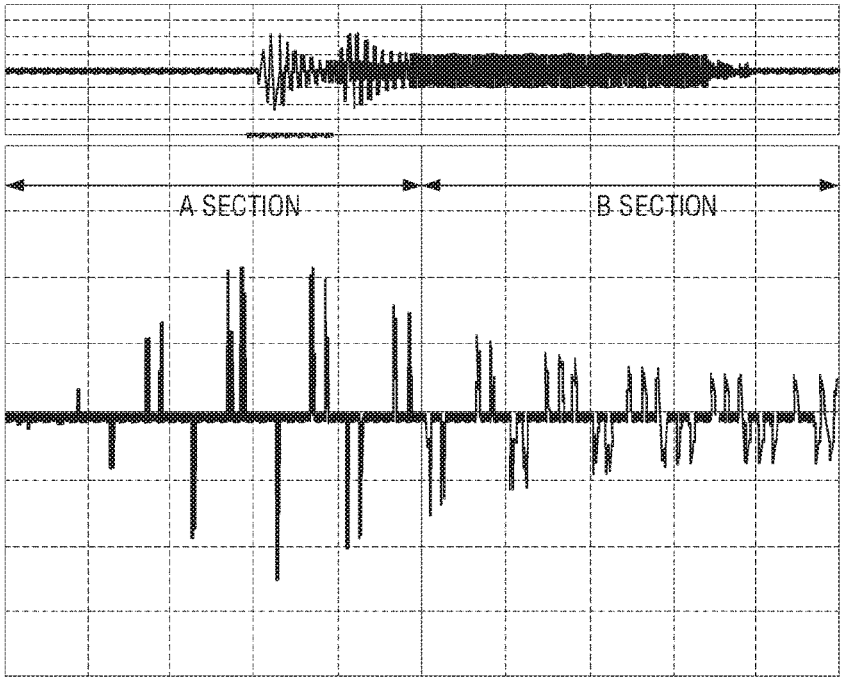
FIG. 6 is a waveform diagram of power being provided to a fuser of a fuser according to an embodiment.

FIG. 6 is a waveform diagram of the power being provided to a fuser of a fuser according to an embodiment.

At an inrush current state in the case of controlling the power being provided to the heating element, the fuser driver according to an embodiment of the present disclosure 200 performs a mixed phase and waveform control.

Referring to FIG. 6, at an initial state of driving (section A), it is possible to perform a phase control of avoiding a predetermined phase angle as in FIG. 5, and after the temperature of the fuser 110 is the same as or above a predetermined temperature (that is, section B), it is possible to perform a waveform number control.

The reason for mixing a phase and waveform number as aforementioned is to reduce noise of the harmonic inductor by performing a phase control and to reduce flickering by performing a waveform number control. In other words, at an initial driving point where a lot of flickering occurs, a phase control of not using a predetermined phase may be performed, and after the fuser 110 is heated above a predetermined temperature, a waveform number control may be performed to reduce noise in the inductor.

Furthermore, the number of times of control may be changed from every 50 Hz to less than every 30 Hz to prevent noise and flickering at the same time. However, reducing the control frequency too much may deteriorate the heat characteristics of the heating element, and thus the frequency may be determined to minimize the effects to the heat characteristics. Especially, a lower limit for the frequency may be proposed so as not to affect the FPOT. That is, the control may be performed within a range between the lower limit and 30 Hz of the system.

Figure 7:
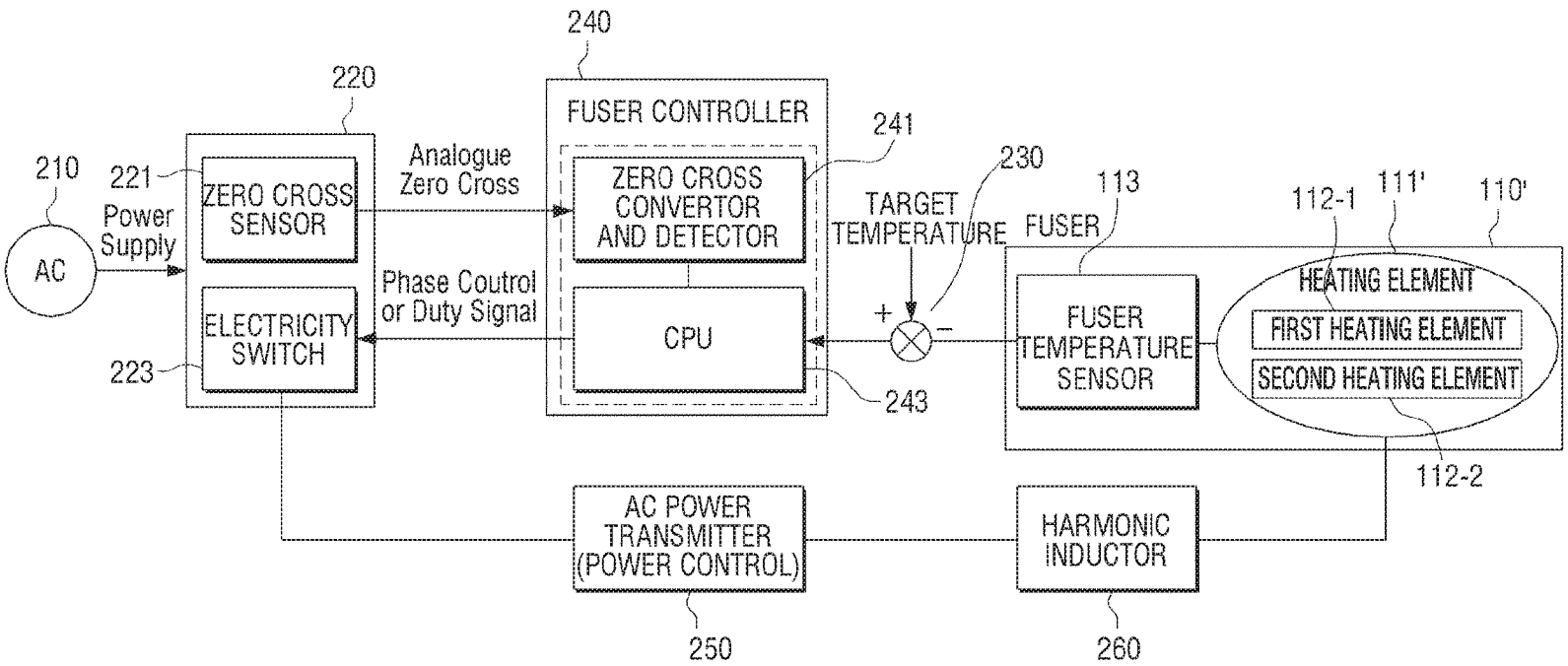
FIG. 7 is a block diagram illustrating a detailed configuration of a fuser according to an embodiment.

FIG. 7 is a block diagram illustrating a detailed configuration of a fuser according to an embodiment. More specifically, a fuser 300' according to the embodiment includes a fuser 110' having a plurality of heating elements 111'.

Referring to FIG. 7, the fuser 300' according to the embodiment includes a fuser 110', input 210, circuit 220, temperature sensor 230, fuser controller 240, electricity transmitter 250, and harmonic inductor 260.

The fuser 110' is provided with a plurality of heating elements 111', including first heating element 112-1 and second heating element 112-2 configured to receive power transmitted through the inductor 260.

The first heating element 112-1 is a heating element arranged at the center of a heating roller. The first heating element 112-1 may consume 700 w of power.

The second heating element 112-2 is a heating element arranged at both sides of the first heating element 112-1. The second heating element 112-2 may consume 600 w of power.

The fuser 110' is provided with a plurality of heating elements 112-1 and 112-2, and thus the electricity switch 223 may switch the power being provided to each of the plurality of heating elements using a plurality of switching elements.

The fuser controller 240 may determine the heating element to be used in a fusing process. More specifically, the fuser controller 240 may receive information on printing paper from the controller 170 of the image forming apparatus 100, and determine to use only the first heating element 112-1 or the first heating element 112-1 and second heating element 112-2 at the same time depending on the received information on printing paper.

For example, in response to the received information on printing paper being less than a predetermined paper size, the fuser controller 240 may determine to use only the first heating element 112-1, and perform a control on driving the first heating element 112-1. However, in response to the received information on printing paper being above the predetermined paper size, the fuser controller 240 may perform a control on driving both the first heating element 112-1 and second heating element 112-2. Herein, a same control method or a different control method may be used to each of the first heating element 112-1 and the second heating element 112-2. Specific control methods were explained hereinabove with reference to FIG. 3, and thus repeated explanation will be omitted.

Meanwhile, when the operational state of the image forming apparatus 100 is at a waiting mode or preparation mode, it is unknown with which printing paper the printing operation will be performed, and thus the fuser controller 240 may control such that power is provided to both the first heating element 112-1 and second heating element 112-2.

Configurations of the input 210, circuit 220, temperature sensor 230, electricity transmitter 250, and harmonic inductor 260 are the same as in FIG. 3, and thus repeated explanation will be omitted.

As aforementioned, even when using a fuser consuming a lot of power, the fuser 300' according to the present embodiment does not provide a predetermined phase that consumes a lot of power to a plurality of heating elements, thereby preventing flickering.

Figure 8:
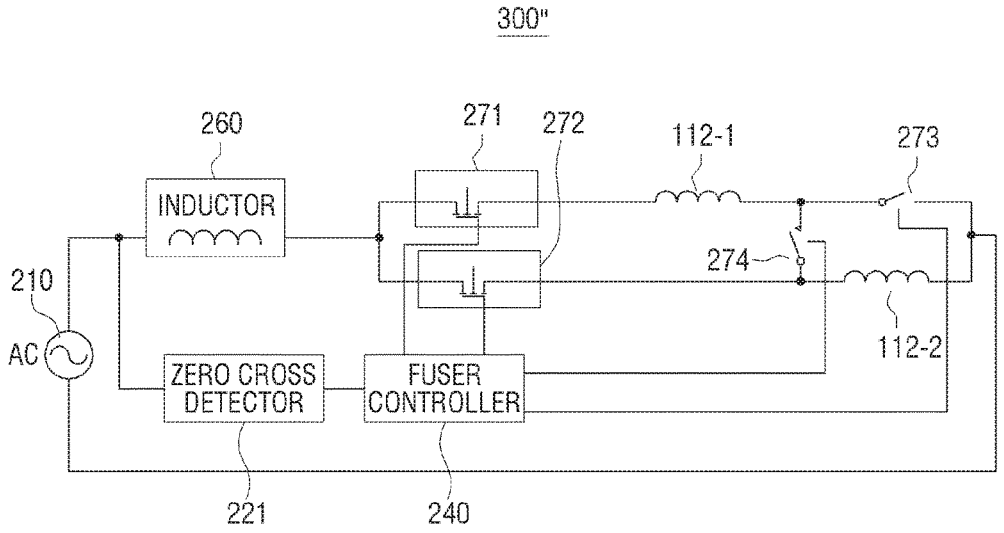
FIG. 8 is a block diagram illustrating a detailed configuration of a fuser according to an embodiment.

FIG. 8 is a block diagram illustrating a detailed configuration of a fuser according to an embodiment. More specifically, the fuser 300" according to the embodiment is provided with a fuser 110' having a plurality of heating elements, and a plurality of switching elements capable of changing the arrangement of the plurality of heating elements.

Referring to FIG. 8, the fuser 300" may include a fuser 110', input 210, zero cross detector 221, fuser controller 240, inductor 260, and a plurality of switching elements 271, 272, 273, and 274.

The fuser 110' is provided with a plurality of heating elements 112-1, 112-2 configured to receive power transmitted through the inductor 260.

The first heating element 112-1 is a heating element arranged at a center of a heating roller. The first heating element 112-1 may consume 700 w of power.

The second heating element 112-2 is a heating element arranged at both sides of the first heating element 112-1. The second heating element 112-2 may consume 600 w of power.

The first heating element 112-1 and second heating element 112-2 may be connected in series or in parallel regarding the AC power by the plurality of switching elements 271, 272, 273, and 274.

The first switching element 271 is arranged between the inductor 260 and first heating element 112-1, and the first switching element 271 may selectively provide external AC to the first heating element 112-1. More specifically, a first end of the first switching element 271 may be connected to a first end of the inductor 260, and second end of the first switching element 271 may be connected to a first end of the first heating element 112-1.

The second switching element 272 is arranged between the inductor 260 and second heating element 112-2, and the second switching element 272 may selectively provide external AC to the second heating element 112-2. More specifically, a first end of the second switching element 272 may be connected to the first end of the inductor 260, and a second end of the second switching element 272 may be connected to a first end of the second heating element 112-2.

The third switching element 273 may selectively connect a second end of the first heating element 112-1 and a second end of the second heating element 112-2.

The fourth switching element 274 may selectively connect the second end of the first heating element 112-1 with the first end of the second heating element 112-2.

The input 210 may receive AC power from outside, and provide the received AC power to the inductor 260 and zero cross sensor 221.

The zero cross sensor 221 senses a zero cross point of the received AC power. Detailed configuration and operations of the zero cross sensor 221 were explained hereinabove with reference to FIG. 3, and thus repeated explanation will be omitted.

The fuser controller 240 changes the operational state of the plurality of switching elements 271, 272, 273, and 274 according to the operational state of the image forming apparatus 100. More specifically, in response to the operational state of the image forming apparatus 100 being at a preparation state or waiting state, a turn-off signal may be applied to the second switching element 272 and third switching element 273, and a turn-on signal may be applied to the fourth switching element 274 so that the first heating element 112-1 and second heating element 112-2 are connected in series. Furthermore, a driving signal may be applied to the first switching element 271.

Meanwhile, in response to the operational state of the image forming apparatus 100 being at a printing state, a turn-on signal may be applied to the third switching element 273, a turn-off signal may be applied to the fourth switching element 274, and a driving signal may be applied to each of the first switching element 271 and second switching element 272. Herein, a same or different signal may be provided to the first switching element 271 and second switching element 272.

Furthermore, the fuser controller 240 may perform a waveform number control using the sensed zero cross point and temperature of the fuser 110', and provide a driving signal according to the waveform number control to the first switching element 271 or to the first switching element 271 and second switching element 272.

As aforementioned, at a preparation state, the fuser 300" according to the present embodiment may connect the first heating element and second element in series, and reduce a through-current by an increase of resistance value. Accordingly, the fuser 300" may supply power by a waveform number control, and accordingly sensitive noise will not occur.

Figure 9:
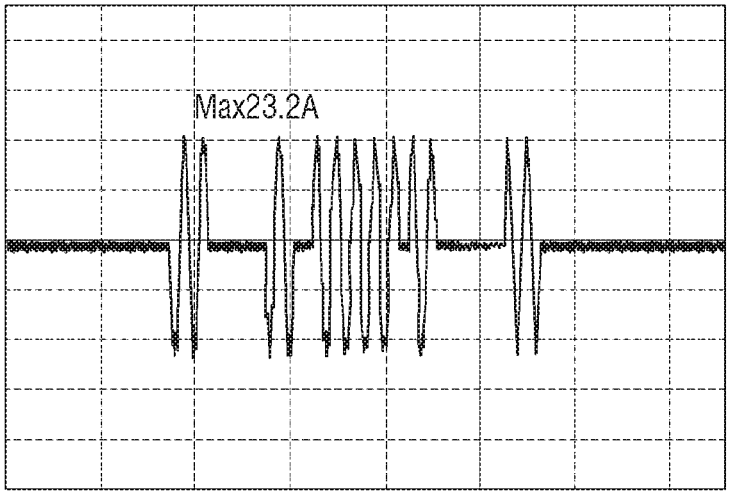
FIG. 9 is a waveform diagram power being provided to a fuser of a fuser according to an embodiment.
Figure 9:
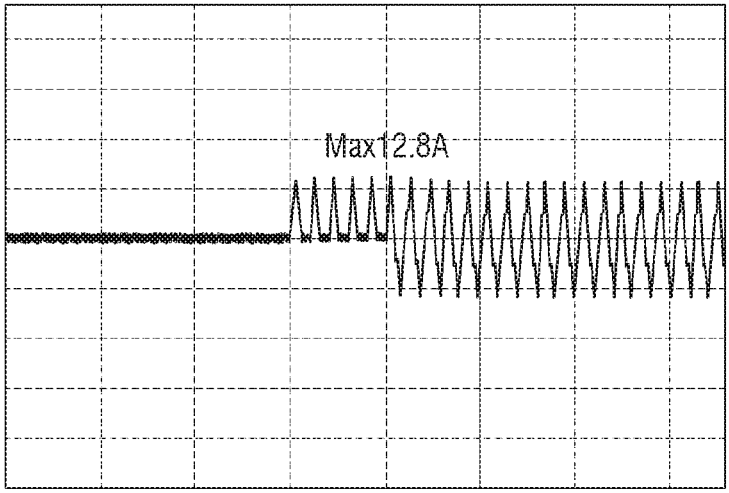

FIG. 9 is a waveform diagram of power being supplied to a fuser of a fuser according to an embodiment. More specifically, FIG. 9 (part a) is a waveform diagram of power being input in the case where a plurality of heating elements are connected in parallel, and FIG. 9 (part b) is a waveform diagram of power being input in the case where a plurality of heating elements are connected in series.

Referring to FIG. 9 (part a) and 9 (part b), it can be seen that when the first heating element and second heating element are connected in series, the through-current of the fuser is reduced.

Because it is possible to reduce the through-current of the fuser 110' by changing the connection state of the heating elements as aforementioned, it is possible to use a waveform number control at a preparation state of the image forming apparatus 100 as well, and accordingly sensitive noise will be significantly reduced.

Figure 10:
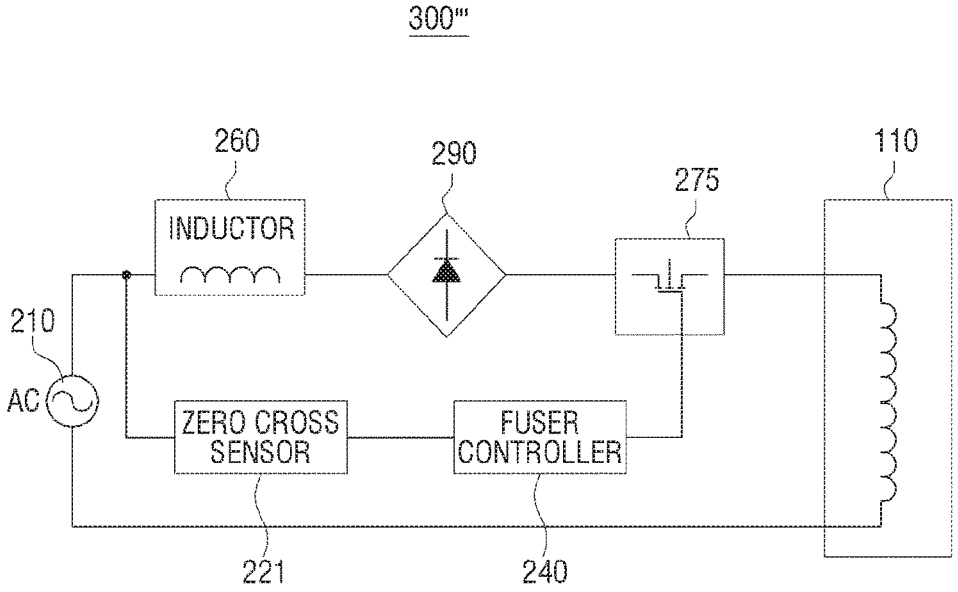
FIG. 10 is a block diagram illustrating a detailed configuration of a fuser according to an embodiment.

FIG. 10 is a view illustrating a configuration of a fuser according to an embodiment.

Referring to FIG. 10, the fuser 300''' according to the embodiment includes a fuser 110, input 210, zero cross detector 221, fuser controller 240, inductor 260, rectifier 290, and switch 275.

The fuser 110 is provided with a heating element 112 for receiving power transmitted through the inductor 260.

The input 210 receives external AC power, and provides the received AC power to the inductor 260 and zero cross sensor 221.

One end of the inductor 260 is connected to one end of the input 210, and another end of the inductor 260 is connected to the rectifier 290.

The rectifier 290 rectifies the AC power transmitted through the inductor 260. Such a rectifier 290 may be a bridge diode rectifier.

The switch 275 may provide the fuser 110 with the AC power selectively rectified according to a control by the fuser controller 240. The fuser 300''' according to the embodiment rectifies the external AC power and uses the same, and thus the fuser 300''' may perform a switching operation using a field-effect transistor rather than a current element.

Operations of the zero cross sensor 221 and fuser controller 240 are the same as in FIG. 3, and thus repeated explanation will be omitted.

Figure 11:
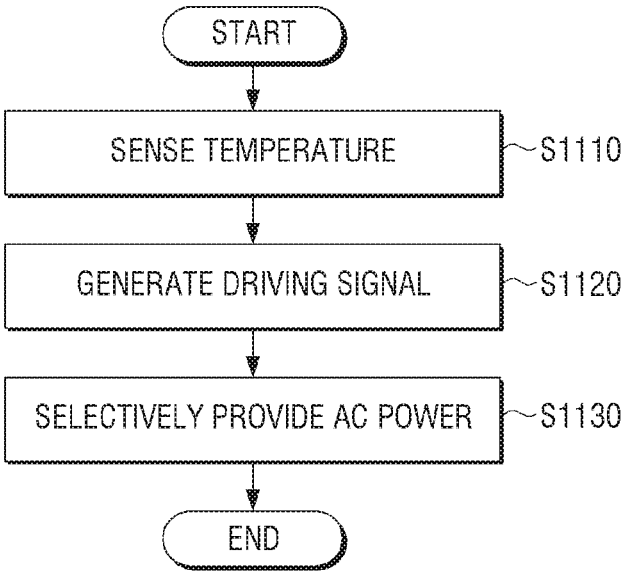
FIG. 11 is a flowchart explaining a method for controlling operations of a fuser according to an embodiment of the present disclosure.

FIG. 11 is a flowchart for explaining a method for controlling operations of a fuser according to an embodiment of the present disclosure.

The temperature of the fuser is sensed (operation S1110). More specifically, the temperature of the fuser may be sensed through a temperature sensor arranged inside the fuser.

A driving signal is generated (operation S1120). More specifically, a control method may be determined according to the operational state of the image forming apparatus 100 and whether or not the arrangement of the plurality of heating elements may be changed, and a driving signal may be generated according to the determined control method and the sensed temperature. For example, in the case where the arrangement of the plurality of heating elements may be changed in a series format, in response to the operational state of the image forming apparatus 100 being at a preparation state, it is possible to maintain the arrangement of the heating element in series and generate a driving signal according to a waveform number control. Furthermore, in response to the operational state of the image forming apparatus 100 being at a printing state, it is possible to change the arrangement of the heating element in a parallel state, and perform a waveform number or phase control and generate a driving signal.

Meanwhile, in the case where the arrangement of the heating element cannot be changed, in response to the operational state of the image forming apparatus 100 being at a preparation state and the temperature of the heating element being below a predetermined temperature, it is possible to generate a driving signal according to a phase control of avoiding a predetermined phase. Furthermore, in response to the operational state of the image forming apparatus 100 being at a printing state or the temperature of the fuser being below the predetermined temperature, it is possible to perform a phase control or waveform number control of supplying power in all phases and generate a driving signal.

AC power is selectively provided to a heating element (operation S1130). More specifically, a driving signal may be applied to a switching element so that AC power is selectively provided to the heating element. However, alternatively, AC power may be primarily rectified, and the rectified AC power may be provided to the heating element.

Therefore, a driving control method of a fuser according to the embodiment is capable of not providing a predetermined phase to the heating element at a preparation state that consumes a lot of power, and reducing the through-current being introduced into the heating element by connecting the plurality of heating elements in parallel, thereby preventing flickering and preventing noise from occurring in the inductor. The driving control method such as that illustrated in FIG. 11 may be implemented on an image forming apparatus having the configuration of FIG. 1 or FIG. 2, or may be implemented on a fuser having a configuration of FIG. 3, FIG. 7, FIG. 8, or FIG. 10, or on an image forming apparatus or fuser having other configurations.

Furthermore, the aforementioned driving control method may be realized as at least one implementation program for implementing the aforementioned driving control method, and such an implementation program may be stored in a computer readable record medium.

Therefore, each block of the present disclosure may be implemented as a computer recordable code on a computer readable record medium. The computer readable record medium may be a device that stores data readable by a computer system.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. An image forming apparatus comprising:

a fuser to fuse developed toner in the image forming apparatus onto a printing paper, and including a heating element; and a processor to generate a driving signal and control to selectively provide alternating current (AC) power to the heating element of the fuser according to the generated driving signal, wherein the processor identifies a phase angle of the received AC power using a zero cross signal, wherein the phase angle of the received AC power is comprised of a first range of the phase angle, a second range of the phase angle, and a third range of the phase angle, wherein the second range of the phase angle and the third range of the phase angle do not overlap the first range of the phase angle, and the first range of the phase angle is between the second range of the phase angle and the third range of the phase angle, wherein the first range of the phase angle includes a peak voltage value and is symmetric about the peak voltage value, and wherein AC power of the first range of the phase angle has a current change greater than a predetermined value that causes flickering and noise, wherein the second range of the phase angle is symmetric to the third range of the phase angle with respect to the peak voltage value, and wherein AC power of the second range of the phase angle has a current change smaller than the predetermined value that does not cause flickering and noise, and AC power of the third range of the phase angle has a current change smaller than the predetermined value and does not cause flickering and noise, wherein, in a waiting state of the image forming apparatus, the processor generates the driving signal while the received AC power is within the second range of the phase angle or the third range of the phase angle, and avoids generating the driving signal while the received AC power is within the first range of the phase angle, and wherein the first range of the phase angle is from 75 to 105 degrees.

2. The apparatus according to claim 1, wherein, in a printing state of the image forming apparatus, the processor generates the driving signal while the received AC power is within the range of the phase angle including the first range of the phase angle.

3. The apparatus according to claim 1, further comprising:

a temperature sensor to sense a temperature of the fuser, wherein, in response to a temperature of the fuser being in a first temperature range, the processor performs a phase control on the power to be provided to the heating element, and in response to the temperature of the fuser being in a second temperature range higher than the first temperature range, the processor performs a waveform number control on the power to be provided to the heating element.

4. The apparatus according to claim 1, wherein the phase angle of the received AC power further comprises a fourth range of the phase angle, the fourth range of the phase angle includes another peak voltage value and is symmetric about the another peak voltage value, and AC power of the fourth range of the phase angle has a current change greater than the predetermined value that causes flickering and noise, and the fourth range of the phase angle is from 255 degrees to 285 degrees.

5. The apparatus according to claim 1, further comprising a plurality of switches;

wherein the heating element comprises a first heating element and a second heating element, the plurality of switches change a connection state of the first heating element and second heating element to be in series or in parallel, and the processor controls the plurality of switches such that, in the waiting state of the image forming apparatus, the first heating element and the second heating element are connected in series, and in a printing state of the image forming apparatus, the first heating element and the second heating element are connected in parallel.

6. The apparatus according to claim 1, further comprising:

an inputter to receive the AC power;

a zero cross sensor to sense a zero cross point of the received AC power;

a temperature sensor to sense a temperature of the fuser; and a switch to selectively provide the power to the heating element, wherein the processor controls an operation of the switch using the sensed zero cross point and the sensed temperature of the fuser.

7. The apparatus according to claim 6, wherein the fuser controller compares the sensed temperature and a predetermined target temperature and computes a duty ratio, calculates a time point to control a phase of the power to be provided to the fuser using the computed duty ratio and sensed zero cross point, and controls the switch based on the calculated time point.

8. The apparatus according to claim 6, wherein, in response to the sensed temperature being greater than or equal to a predetermined temperature, the processor performs a waveform number control on the AC power to be provided to the heating element.

9. The apparatus according to claim 6, wherein the switch is a triode for alternating current (TRIAC).

10. The apparatus according to claim 9, further comprising a coil arranged between the switch and the heating element.

11. The apparatus according to claim 6, wherein the processor further comprises a rectifier to wave-rectify the received AC power and a coil arranged between the input and rectifier, and wherein the switch is a field-effect transistor.

12. An image forming apparatus comprising:

a fuser to fuse developed toner in the image forming apparatus onto a printing paper, and including a first heating element and a second heating element; and a fuser driver to receive alternating current (AC) power and selectively provide power to the first heating element and the second heating element so that the fuser reaches a predetermined temperature, wherein, in a waiting state of the image forming apparatus, the fuser driver connects the first heating element and the second heating element in series, and in a printing state of the image forming apparatus, the fuser driver connects the first heating element and the second heating element in parallel, and wherein the fuser driver comprises:

a temperature sensor to sense a temperature of the fuser;

an inputter to receive the AC power;

a coil connected to one end of the inputter;

a first switch arranged between the coil and a first end of the first heating element, and to selectively provide the power to the first heating element;

a second switch arranged between the coil and a first end of the second heating element, and to selectively provide the power to the second heating element;

a third switch to selectively connect a second end of the first heating element with a second end of the second heating element;

a fourth switch to selectively connect the second end of the first heating element with the first end of the second heating element; and a fuser controller to, in the waiting state, control the fourth switch to maintain a turn-on state, and the second switch and third switch to maintain a turn-off state, and control the first switch according to the sensed temperature, and in the printing state, control the third switch to maintain a turn-on state, and fourth switch to maintain a turn-off state, and control the first switch and second switch separately according to the sensed temperature.

13. A driving control method of a fuser of an image forming apparatus, the method comprising:

sensing a temperature of the fuser;

generating a driving signal based on the sensed temperature; and selectively providing power to a heating element of the fuser according to the generated driving signal;

wherein the generating the driving signal includes identifying a phase angle of received AC power using a zero cross signal, wherein the phase angle of the received AC power is comprised of a first range of the phase angle, a second range of the phase angle, and a third range of the phase angle, wherein the second range of the phase angle and the third range of the phase angle do not overlap the first range of the phase angle, and the first range of the phase angle is between the second range of the phase angle and the third range of the phase angle, wherein the first range of the phase angle includes a peak voltage value and is symmetric about the peak voltage value, and wherein AC power of the first range of the phase angle has a current change greater than a predetermined value that causes flickering and noise, wherein the second range of the phase angle is symmetric to the third range of the phase angle with respect to the peak voltage value, and wherein AC power of the second range of the phase angle has a current change smaller than the predetermined value that does not cause flickering and noise, and AC power of the third range of the phase angle has a current change smaller than the predetermined value and does not cause flickering and noise, wherein the generating the driving signal comprises, in a waiting state of the image forming apparatus, generating the driving signal by using received AC power of the second range of the phase angle and the third range of the phase angle, and avoiding generating the driving signal by using the received AC power of the first range of the phase angle, and wherein the first range of the phase angle is from 75 to 105 degrees.

14. The method according to claim 13, wherein the generating the driving signal includes, in a printing state of the image forming apparatus, generating the driving signal by using the received AC power of the range of the phase angle including the first range of the phase angle.

15. The method according to claim 13, wherein the generating the driving signal includes, in response to the temperature of the fuser being in a first temperature range, performing a phase control on the power being provided to the heating element to generate the driving signal, and in response to the temperature of the fuser being a second temperature range higher than the first temperature range, performing a waveform number control on the power being provided to the heating element to generate the driving signal.

16. The method according to claim 13, wherein the phase angle of the received AC power further comprises a fourth range of the phase angle, the fourth range of the phase angle includes another peak voltage value and is symmetric about the another peak voltage value, and AC power of the fourth range of the phase angle has a current change greater than the predetermined value that causes flickering and noise, and the fourth range of the phase angle is from 255 degrees to 285 degrees.

17. The method according to claim 13, further comprising sensing a zero cross point of the received power, wherein the generating the driving signal includes generating the driving signal using the sensed zero cross point.

18. The method according to claim 17, wherein the generating the driving signal includes comparing the sensed temperature and a predetermined target temperature to compute a duty ratio, calculating a time point to control a phase of the power to be provided to the fuser using the computed duty ratio and sensed zero cross point, and generating the driving signal based on the calculated time point.

19. The method according to claim 13, wherein the heating element comprises a first heating element and a second heating element, and the selectively providing the power includes, in the waiting state of the image forming apparatus, connecting the first heating element and second heating element in series, and in a printing state of the image forming apparatus, connecting the first heating element and the second heating element in parallel.

20. The apparatus according to claim 1, wherein the second range of the phase angle encompasses a range in degrees equal to a range in degrees encompassed by the third range of the phase angle, and the first range of the phase angle encompasses a range in degrees less than the range of degrees encompassed by the second range of the phase angle.

* * * * *